US007623567B2

(12) United States Patent
Wilms

(10) Patent No.: US 7,623,567 B2
(45) Date of Patent: Nov. 24, 2009

(54) METHOD FOR TRANSMITTING DATA FOR CONTROLLING RAILWAY SIGNAL INSTALLATIONS OF A RAILWAY SYSTEM

(75) Inventor: Gerhard Wilms, Braunschweig (DE)

(73) Assignee: Siemens Aktiengesellschaft, München (DE)

( * ) Notice: Subject to any disclaimer, the term of this patent is extended or adjusted under 35 U.S.C. 154(b) by 538 days.

(21) Appl. No.: 11/557,594

(22) Filed: Nov. 8, 2006

(65) Prior Publication Data

US 2007/0150131 A1 Jun. 28, 2007

(30) Foreign Application Priority Data

Dec. 23, 2005 (DE) ..... 10 2005 062 850

(51) Int. Cl.
*H04B 1/38* (2006.01)
*H04L 5/16* (2006.01)
*B61L 21/00* (2006.01)

(52) U.S. Cl. ..... 375/219; 375/259; 246/34 B; 246/34 CT

(58) Field of Classification Search ..... 375/219, 375/259; 246/28 R, 33, 34 R, 34 B, 34 CT, 246/38

See application file for complete search history.

(56) References Cited

U.S. PATENT DOCUMENTS 2,515,868 A * 7/1950 Gilson ..... 246/34 R
3,794,832 A * 2/1974 Huffman et al. ..... 246/33
3,868,075 A * 2/1975 Blazek et al. ..... 246/34 CT
5,271,584 A * 12/1993 Hochman et al. ..... 246/34 B

* cited by examiner

*Primary Examiner*—David B Lugo
(74) *Attorney, Agent, or Firm*—Henry M. Feiereisen; Ursula B. Day

(57) ABSTRACT

A method for controlling railway signal installations of a railway system by exchanging data between directly adjacent transceivers over electrically conducting rails of a track is disclosed. More particularly, the method allows bidirectional data exchange between the transceivers without employing track sections with insulating joints. Data are exchanged during alternating transmit and receive cycles which each have three separate time intervals. Signal pulses are received at the transceivers either depending on their polarity during the transmit and receive cycles, or the signal pulses are prepended with an identification pulse. In this way, only one transceiver is enabled to transmit and only one receiver is enabled to receive the transmitted signal pulses in a given time interval.

3 Claims, 3 Drawing Sheets

METHOD FOR TRANSMITTING DATA FOR CONTROLLING RAILWAY SIGNAL INSTALLATIONS OF A RAILWAY SYSTEM

CROSS-REFERENCES TO RELATED APPLICATIONS

This application claims the priority of German Patent Application, Ser. No. 10 2005 062 850.8, filed Dec. 23, 2005, pursuant to 35 U.S.C. 119(a)-(d), the content of which is incorporated herein by reference in its entirety as if fully set forth herein.

BACKGROUND OF THE INVENTION

The present invention relates, in general, to a method for controlling railway signal installations of a railway system.

Nothing in the following discussion of the state of the art is to be construed as an admission of prior art.

Transmitter/receiver devices, also referred to as transceivers, are commonly used to transmit data via the rail for controlling railway signal installations. The transceivers are connected to the two electrically conducting rails of the track, wherein the transmit cycles and the receive cycles alternatingly repeat for each of the transceivers. Data are transmitted by signal pulses exchanged between directly adjacent transceivers via DC-encoded DC circuits. The rails include electrically insulated rail joints (also referred to as mechanical insulated joints), so that the respective transceivers located in a region between two directly adjacent rail joints can exchange the data without interference from the more distant transceivers.

The use of insulated joints is expensive and susceptive to errors. In particular, repairs performed on the insulated joints may cause unacceptable train delays.

It would therefore be desirable and advantageous to provide an improved method for data transmission over the rails, which method obviates prior art shortcomings and which is prone to little error and cost-efficient.

SUMMARY OF THE INVENTION

According to one aspect of the present invention, a method is disclosed for transmitting data for controlling railway signal installations of a railway system, wherein a track is formed of at least two electrically conducting rails and transceivers are connected to the rails. Data are exchanged between directly adjacent transceivers by signal pulses transmitted over the rails, with one of the two transceivers operating as a transmitter and the other as a receiver, and with transmission and reception repeating in alternating cycles. Each transmit cycle and each receive cycle has three time intervals, with the signal pulses being transmitted only during two time intervals of the transmit cycle, namely during one in the two time intervals with a negative polarity and during the other of the two time intervals with a positive polarity. The signal pulses are each received only during two of the three time intervals of the receive cycle. During one in the two time intervals, only signal pulses with negative polarity are received, whereas during the other time interval only signal pulses with positive polarity are received. The sequential order of the three time intervals of the transmit cycles and the three time intervals of the receive cycle for a transceiver and its directly adjacent transceivers is defined so that during each time interval only one transceiver transmits signal pulses and only one transceiver receives these signal pulses.

Using signal pulses with different polarity enables each transceiver to exchange data with the two directly adjacent transceivers without requiring electrically insulated joints. Each of the three transceivers only transmits during one of the three time intervals of a transmit cycle. Likewise, only one respective transceiver receives during one of the three time intervals of a receive cycle, as determined by the polarity of the signal pulses, wherein a corresponding polarity is associated with two respective time intervals of a receive cycle. Because this applies to each transceiver, data can be exchanged without interference from the more distant transceivers.

According to another aspect of the invention, a method is described for transmitting data for controlling railway signal installations of a railway system, with a track formed of at least two electrically conducting rails and transceivers connected to the rails, wherein respective directly adjacent transceivers exchange the data via signal pulses over the rails during alternatingly repeating transmit and receive cycles. The polarity of the signal pulses can be negative or positive. Each transmit cycle and each receive cycle includes three time intervals, wherein the signal pulses are each transmitted during one time interval of the transmit cycle with a negative identification pulse and during another time interval of the transmit cycle with a positive identification pulse. On the receiving side, the signal pulses with a negative identification pulse are received during one time interval of the receive cycle, whereas the signal pulses with a positive identification pulse are received during another time interval of the receive cycle. The sequential order of the three time intervals of the transmit cycle and of the three time intervals of the receive cycle for a transceiver and its directly adjacent transceivers are defined so that during each time interval only one transceiver transmits signal pulses and only one transceiver receives these signal pulses.

With this method, unlike the first method, the signal pulses can have both negative and positive components, whereby identification pulses with a defined polarity are used for identifying the signal pulses.

According to another feature of the present invention, the identification pulses may be disposed at the beginning of a signal pulse and have a predetermined pulse length.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
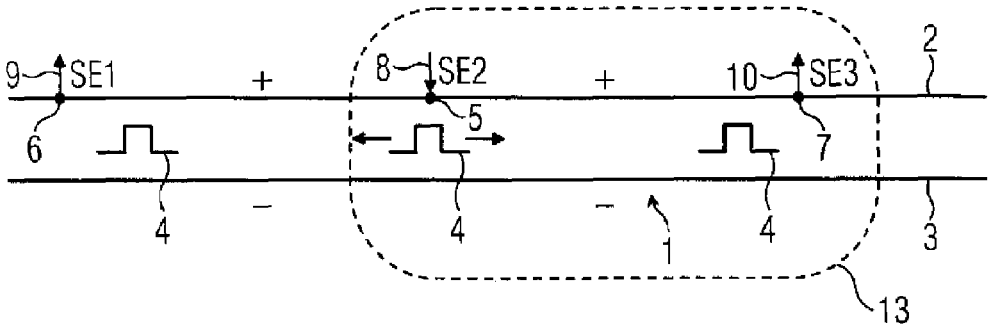
FIG. 1 shows schematically an embodiment with three directly adjacent transceivers, with a centrally located transceiver operating as a transmitter of signal pulses.

Throughout all the Figures, same or corresponding elements are generally indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a track section 1 of a railway system (not shown), wherein the track has two rails 2, 3. To control the railway signal installations of the railway system, the transceivers SE transmit data in the form of DC-encoded signal pulses 4 (signals) via the two rails 2, 3. FIG. 1 depicts schematically three transceivers SE1, SE2, SE3, wherein the two transceivers SE1, SE3 are directly adjacent to the transceiver SE2. The transceivers SE1, SE2, SE3 can feed the signal pulses 4 to the two electrically conducting rails 2, 3 at the corresponding feed/decoupling points 5, 6, 7 or decouple (receive) the signal pulses 4 from the rails 2, 3 at these feed/decoupling points 5, 6, 7.

Transmit and receive cycles repeat alternatingly, with each transmit cycle and each receive cycle including three time intervals. FIG. 1 shows the situation for one of these three time intervals.

The signal pulses 4 in FIG. 1 have a positive polarity, i.e., they are positive signal pulses 4, and accordingly the positive polarity (+ in FIG. 1) is connected to rail 2 and the negative polarity (− in FIG. 1) is connected to rail 3.

In the illustrated time interval, the transceiver SE2 operates as a transmitter which couples positive signal pulses 4 at the feed/decoupling point 5 into the two electrically conducting rails 2, 3, as indicated schematically by the arrow 8 pointing to the feed/decoupling point 5. The signal pulses 4 transmitted from the transceiver SE2 propagate from the transceiver SE2 to both the transceiver SE1 and the transceiver SE3, i.e., to the left and right side in FIG. 1 (because there are no insulated joints).

After a certain propagation time, the signal pulses 4 reach the feed/decoupling points 6 and 7, wherein they can in principle be received by the two directly adjacent transceivers SE1 and SE3, as indicated in FIG. 1 by the arrows 9,10 pointing array from the feed/decoupling points 6, 7. However, the positive signal pulses 4 can generally be received by one transceiver, in this example the transceiver SE3, because only this transceiver of the two transceivers SE1 and SE3 is controlled to receive the positive signal pulses 4 during the time interval shown in FIG. 1. Conversely, the transceiver SE1 is controlled so as to only receive negative signal pulses 4. The broken line 13 in FIG. 1 is intended to indicate that data transmission occurs only between the transceiver SE2 and the transceiver SE3.

During the time interval considered in FIG. 1, only the transceiver SE2 transmits the signals, and only the transceiver SE3 receives the signals, although the signal pulses 4 propagate to the left and to the right with reference to FIG. 1.

Figure 2:
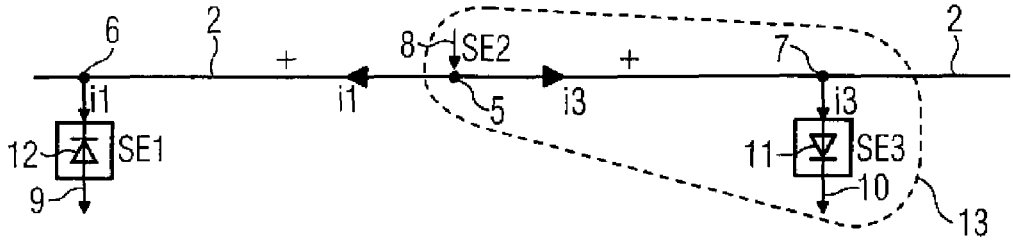
FIG. 2 shows schematically the embodiment of FIG. 1, with the centrally located transceiver transmitting positive signal pulses in a first time interval.

FIG. 2 shows the same situation as in FIG. 1 with a slight modification. The various currents i of the signal pulses 4 are illustrated, which flow as partial currents i1, i3 through the rail 2 and on the return through rail 3. The polarity dependence of the transceivers SE1 and SE3 is schematically indicated by respective diodes 11, 12, whereby with the indicated polarity only the diode 11 of the transceiver SE3 is conducting, whereas the diode 12 is blocking.

The diodes 11, 12 connected in opposite directions indicate that only the transceiver SE3 is able to receive the positive signal pulses 4 from the transceiver SE2.

The broken line 13 in FIG. 2 again illustrates that data are transmitted only between the transceiver SE2 and the transceiver SE3.

Figure 3:
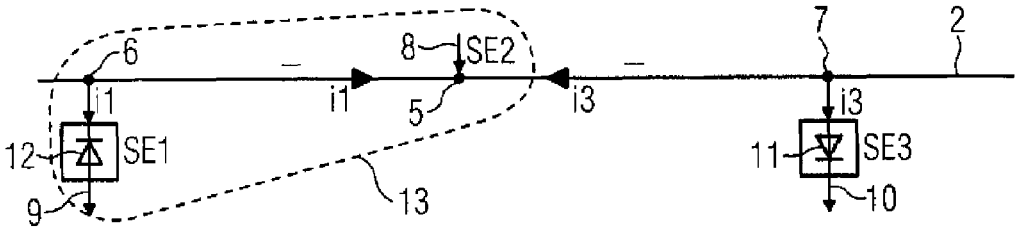
FIG. 3 shows schematically the embodiment of FIG. 1, with the centrally located transceiver transmitting negative signal pulses in a second time interval.

FIG. 3 shows the situation of FIG. 2 for a different time interval. The transceiver SE2 operates during this time interval again as a transmitter, but transmits negative signal pulses 4. The polarity reversal causes a reversal of the direction of the current flow i and hence also of the arrow with respect to FIG. 2. As shown by the broken line 13, the negative signal pulses 4 are only received by the transceiver SE1, because the diode 12 is now conducting. The transceiver SE3 does not receive a signal because diode 11 is blocking.

FIGS. 2 and 3 show schematically the operating mode of the transceivers only during the time interval of interest.

Figure 4:
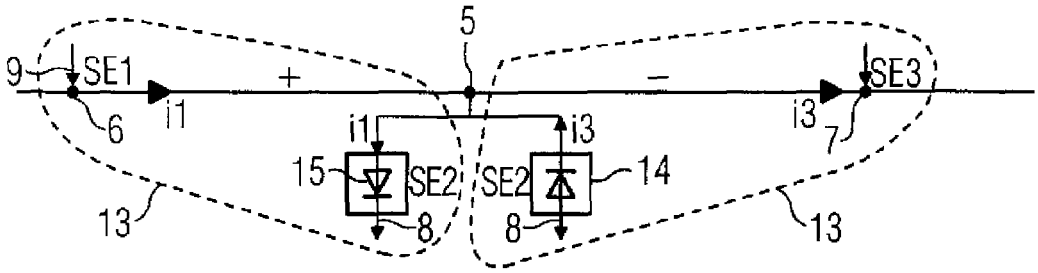
FIG. 4 shows schematically the embodiment of FIG. 1, with the centrally located transceiver operating as a receiver of signal pulses of opposite polarity emitted by two directly adjacent transceivers operating as transmitters.

FIG. 4 shows a different embodiment, where each of the transceivers SE1 and SE3 operates as a transmitter during two of the time intervals while the transceiver SE2 operates as a receiver. The polarity of all the transceivers SE1, SE2, SE3 can be inverted, as indicated in FIG. 4 by the two antiparallel-connected diodes 14, 15, but only for the transceiver SE2 operating as a receiver. The switchable transceiver SE2 is switched so as to be able to receive negative signal pulses 4 (via the diode 15) during one time interval and positive signal pulses 4 (via the diode 14) during another time interval. Accordingly, the transceiver SE2 receives the negative signal pulses 4 from the transceiver SE3 via the diodes 14 and receives signal pulses 4 via the diode 15 during another time interval when the transceiver SE1 transmits positive pulses 4. FIG. 4 shows the situation for two consecutive time intervals during which the transceivers SE1 and SE3 transmit signal pulses 4 with different polarity and the transceiver SE2 as the designated receiver receives the signal pulses 4, during one time interval exclusively from the transceiver SE1 and during the other time interval exclusively from the transceiver SE3.

FIG. 4 does not explicitly show a third operating mode of the transceivers SE and therefore also of the transceiver SE2, namely where the two diodes 14, 15 are connected so as to be blocking. In this operating mode, signal pulses 4 of the transceiver can be neither received nor transmitted.

FIG. 4 also does not show that the polarity of the two transceivers SE1 and SE3, which in FIG. 4 operate as transmitters, can be switched, where depending on the selected operating mode, the data are transmitted either as negative or as positive signal pulses 4. Alternatively, no signal pulses 4 may be transmitted (blocking mode).

In addition to the blocking mode, each transceiver SE can therefore be operated either as a transmitter or as a receiver, and can be switched during the transmit mode as well as during the receive mode between negative and positive signal pulses 4.

Figure 5:
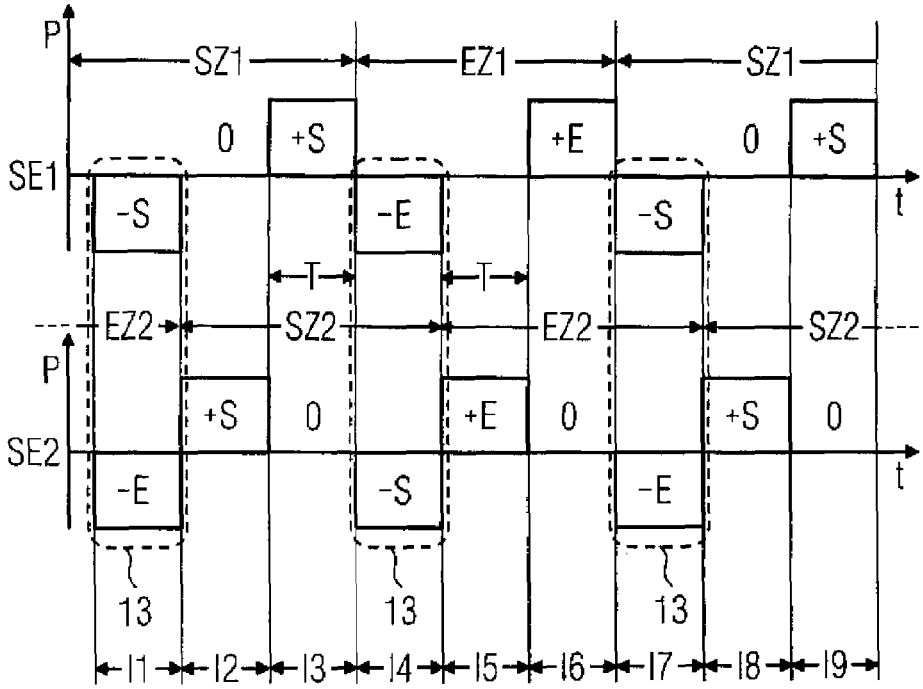
FIG. 5 shows exemplary consecutive transmit cycles SZ and receive cycles EZ for two directly adjacent transceivers SE1 and SE2 as a function of time t.

FIG. 5 shows exemplary consecutive transmit cycles SZ and receive cycles EZ for two transceivers SE1 and SE2 as a function of time t. Each cycle SZ and EZ is divided into three time intervals I having a time duration T, wherein each transmit cycle SZ is characterized by −S, 0, or +S. The designation −S in the transmit cycle indicates that only negative signal pulses can be transmitted from the transceiver SE; correspondingly for +S, only positive signal pulses 4 can be transmitted. The designation 0 indicates that no signal pulses 4, i.e., neither positive nor negative signal pulses 4, can be transmitted (blocking mode). The designation −E, 0, +E for the receive cycles EZ operates in a similar manner: −E indicates that negative signal pulses 4 can be received, whereas +E indicates the same for positive signal pulses 4. The identifier 0 again indicates the blocking mode, i.e., neither positive nor negative signal pulses 4 can be received.

As shown in FIG. 5, the alternatingly repeating transmit and receive cycles SZ, EZ of the various transceivers (here SE1 and SE2) are offset from each other by a time interval (a time duration T). A skilled artisan will understand that the offset can also include more than one time interval. The sequential order of the time intervals, i.e. −S, 0, +S and −E, 0, +E for the various transceivers can also be changed, for example in the illustrated reverse order, even when the sequential order always repeats for the same transceiver SE. With the exemplary sequential order of FIG. 5, the transceiver SE1 transmits (can transmit) negative signal pulses 4 during the time interval I1 and the transceiver SE2 receives (can receive) these negative signal pulses 4, with this pattern in the illustrated example repeating during time interval I7. Conversely, the transceiver SE1 receives negative signal pulses 4 from the transceiver SE2 during the time interval I4. Data transmission between the transceiver SE1 and the transceiver SE2 is not possible during the time intervals I2, I3, I5, I6, and I8.

Figure 6:
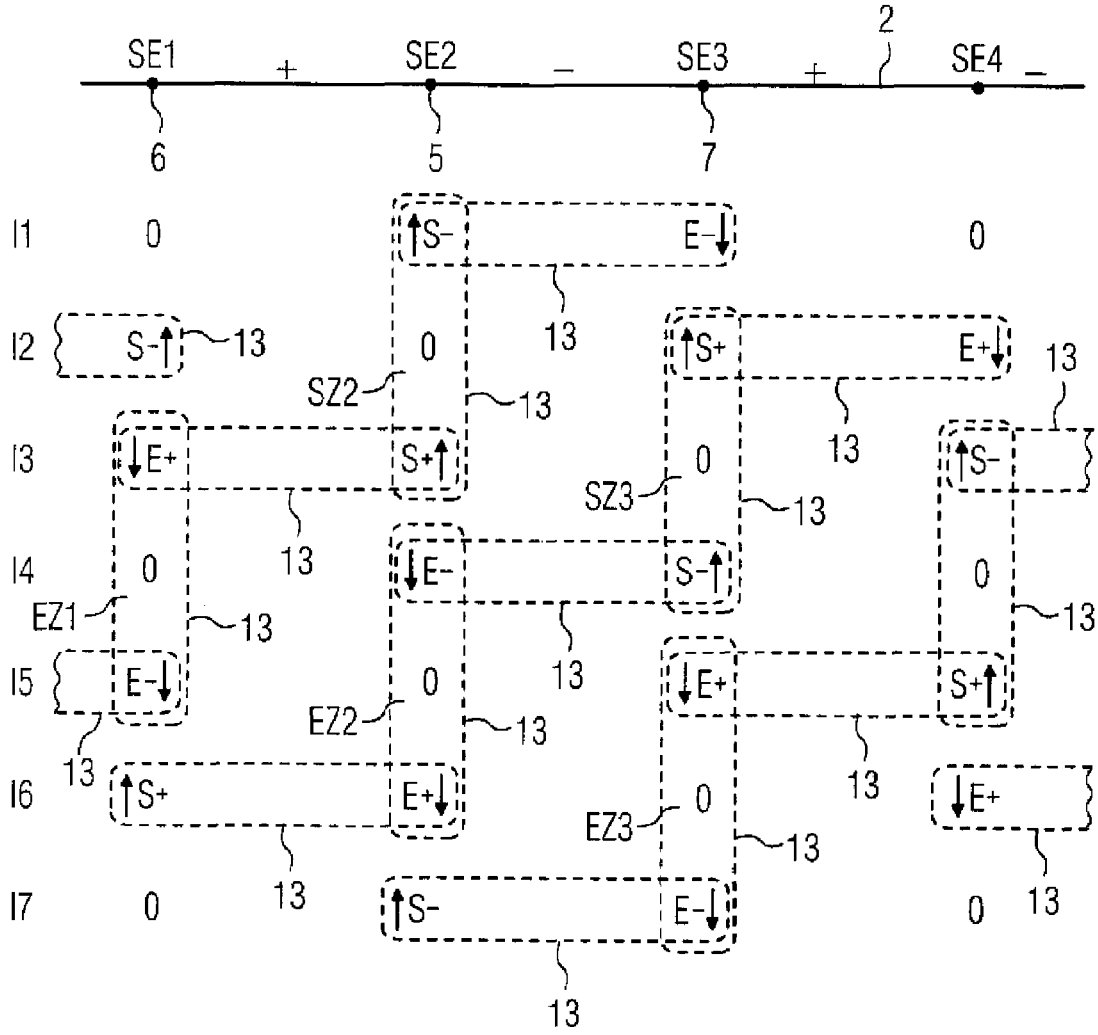
FIG. 6 shows an embodiment with four transceivers and possible signal transmissions between adjacent ones of the four transceivers.

FIG. 6 shows possible connections between the three transceivers SE1, SE2, SE3 and an additional directly adjacent transceiver SE4. The time intervals I (I1 to I7) in FIG. 6 are shown consecutively from the top of the page down. The identifiers −S, 0, +S and −E, 0, +E for the transceivers SE1-SE4 repeat in this example always in the same sequential order, as previously discussed with reference to FIG. 5. The broken lines 13 indicate which of the four adjacent transceivers SE1-SE4 transmit signal pulses 4 and the corresponding polarities of these pulses.

In the exemplary embodiment depicted in FIG. 6, only two directly adjacent transceivers SE are enabled to transmit the signal pulses 4 from one transceiver SE to another.

The height or amplitude of the signal pulses can vary, i.e., need not be constant, but the signal pulses 4 must have the correct polarity.

FIGS. 5 and 6 show clearly that each transmit cycle SZ and each receive cycle EZ includes exactly three time intervals I, with the signal pulses 4 being transmitted only during two time intervals I of the transmit cycle SZ, namely during one of the two time intervals I as negative signal pulses 4 and during the other two time intervals I as positive signal pulses 4. The signal pulses 4 are received only during two time intervals I of the receive cycle EZ, namely during one of the two time intervals I only the negative signal pulses 4 are received and during the other two time intervals only the positive signal pulses 4 are received. The order of the two time intervals I, i.e., the sequential order of the identifiers of the transmit cycles and receive cycles for a transceiver SE, is defined so that during each time interval I only one transceiver SE transmits signal pulses 4 and only one transceiver SE receives these signal pulses 4. These are in FIGS. 2-7 the two transceivers SE enclosed by the broken line 13.

Figure 7:
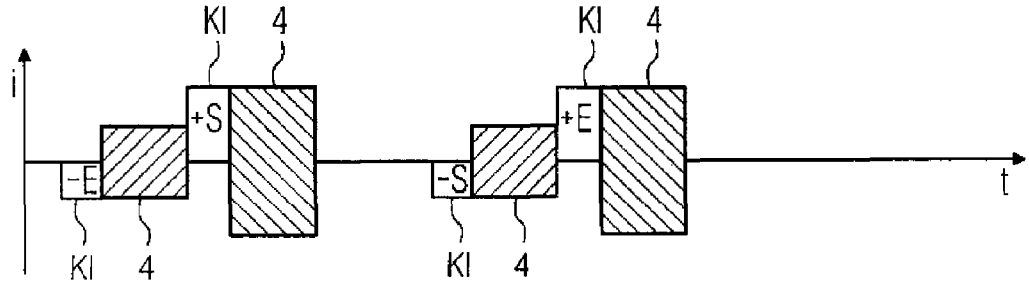
FIG. 7 shows an embodiment for transmission of bipolar signal pulses by using an additional identification pulse.

FIG. 7 shows an embodiment where the signal pulses 4 can be either negative or positive. In the example illustrated in FIG. 7, the signal pulses 4 are prepended within the corresponding time interval I by an identification pulse KI. This identification pulse KI has a corresponding polarity. In analogy to FIGS. 5 and 6, the signal pulses can only be received when the identification pulses KI have the corresponding polarity, because only then are the associated transceivers SE set to transmit and receive, respectively.

Accordingly, the operating principle is similar to that of FIGS. 5 and 6, except that the identification pulses KI can be used to enable the respective transceivers SE. Only the enabled transceivers SE, of which one is a transmitter and another is a receiver, are capable of transmitting signal pulses 4 in a corresponding direction.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method for controlling railway signal installations of a railway system by transmission of data between directly adjacent transceivers operatively connected to electrically conducting rails of a track, comprising the steps of:

defining a transmit cycle and a receive cycle for the transmission, with the transmit cycle and the receive cycle each comprising three separate time intervals;

transmitting signal pulses from a transceiver operating as a transmitter to directly adjacent transceivers operating as receivers with a negative polarity in one of the two time intervals of the transmit cycle and with a positive polarity in the other of the two time intervals of the transmit cycle;

receiving the signal pulses at the directly adjacent transceivers operating as a receivers only during two of the three time intervals of the receive cycle, wherein during one in the two time intervals only signals with negative polarity are received and during the other of the two time intervals only signals with positive polarity are received;

wherein a sequential order of the three time intervals of the transmit cycle and a sequential order of the three time intervals of the receive cycle for the transceiver operating as a transmitter and the directly adjacent transceivers operating as receivers are defined so that in each time interval only one transceiver transmits the signal pulses and only one of the other transceivers receives the signal pulses; and cyclically repeating alternating transmit and receive cycles for each of the transceivers.

2. A method for controlling railway signal installations of a railway system by transmission of data between directly adjacent transceivers connected to electrically conducting rails of a track via the rails, comprising the steps of:

defining a transmit cycle and a receive cycle for the transmission, with the transmit cycle and the receive cycle each comprising three separate time intervals;

transmitting signal pulses having one of negative or positive polarity, wherein the signal pulses are transmitted in one time interval of the transmit cycle with a negative identification pulse and in another time interval of the transmit cycle with a positive identification pulse;

receiving in one time interval of the receive cycle the signal pulses with a negative identification pulse, and receiving in another time interval of the receive cycle the signal pulses with a positive identification pulse, wherein a sequential order of the three time intervals of the transmit cycle and a sequential order of the three time intervals of the receive cycle are defined for a transceiver operating as a transmitter and directly adjacent transceivers operating as receivers so that in each time interval only one transceiver transmits signal pulses and only one transceiver receives these signal pulses, and cyclically repeating alternating transmit and receive cycles for each of the transceivers.

3. The method of claim 2, wherein the positive and the negative identification pulses have a predetermined pulse length and are applied at the beginning of the signal pulses transmitted in a time interval of the transmit cycle.

* * * * *